US006017281A

United States Patent [19]

Behling

[11] Patent Number: 6,017,281

[45] Date of Patent: Jan. 25, 2000

[54] GOLF PUTTER

[76] Inventor: Gary A. Behling, 1940 Weiss St., Saginaw, Mich. 48602

[21] Appl. No.: 09/072,935

[22] Filed: May 5, 1998

[51] Int. Cl.[7] ..... A63B 53/04

[52] U.S. Cl. ..... 473/330; 473/409; 473/313; 473/340; 473/329

[58] Field of Search ..... 473/340, 341, 473/324, 409, 313, 330, 331, 251, 252, 253, 254, 255, 329, 332, 349, 242, 226, 227, 238, 257

[56] References Cited

U.S. PATENT DOCUMENTS

| | | |
|---|---|---|
| D. 138,380 | 7/1944 | Myers et al. . |
| D. 197,238 | 12/1963 | Lilly . |
| D. 208,984 | 10/1967 | Huelsman et al. . |
| D. 209,294 | 11/1967 | Hitt . |
| D. 228,513 | 10/1973 | Brower . |
| D. 239,454 | 4/1976 | Giambazi . |
| D. 303,559 | 9/1989 | Florian . |
| D. 378,934 | 4/1997 | Clanton . |
| D. 385,321 | 10/1997 | Quattrochi . |
| 1,038,429 | 9/1912 | Penny . |
| 1,211,708 | 1/1917 | Hudson . |
| 1,467,714 | 9/1923 | Doerr . |
| 2,472,978 | 6/1949 | Mahon . |
| 2,665,909 | 1/1954 | Wilson . |
| 2,826,417 | 3/1958 | Marcoccio . |
| 3,194,564 | 7/1965 | Swan . |
| 3,211,455 | 10/1965 | Hyden . |
| 3,328,032 | 6/1967 | Griswold . |
| 3,384,376 | 5/1968 | Greenlee . |
| 3,399,898 | 9/1968 | Burkland . |
| 3,843,122 | 10/1974 | Florian . |
| 4,290,606 | 9/1981 | Maxwell . |
| 4,536,454 | 8/1985 | Haasl . |
| 4,650,191 | 3/1987 | Mills . |
| 4,953,867 | 9/1990 | Rigsby . |
| 4,960,279 | 10/1990 | Harris . |
| 5,029,865 | 7/1991 | Kim . |
| 5,273,282 | 12/1993 | Cannon . |
| 5,333,873 | 8/1994 | Burke . |
| 5,354,060 | 10/1994 | Wooten . |
| 5,362,056 | 11/1994 | Minotti . |
| 5,382,019 | 1/1995 | Sneed . |
| 5,383,664 | 1/1995 | Epperson . |
| 5,433,441 | 7/1995 | Olsen et al. . |
| 5,441,272 | 8/1995 | Artola . |
| 5,458,332 | 10/1995 | Fisher . |
| 5,460,375 | 10/1995 | Hardee . |
| 5,467,987 | 11/1995 | Perkins et al. . |
| 5,542,675 | 8/1996 | Micciche et al. . |
| 5,597,364 | 1/1997 | Thompson . |
| 5,632,694 | 5/1997 | Lee . |

*Primary Examiner*—Sebastiano Passaniti

*Attorney, Agent, or Firm*—Reising, Ethington, Barnes, Kisselle, Learman & McCulloch, P.C.

[57] ABSTRACT

A golf putter comprises a shaft having a grip at one end and a head fixed to the opposite end. The head has a main body section that extends transversely of the shaft. The main body section has a generally cylindrical configuration with a diameter substantially less than that of a standard golf ball. The main body section is encapsulated by a layer of resilient, fraction-enhancing material that extends across the striking face of the club head to grip the ball on impact and provide a cushioned, controlled feel when striking the ball. The putter head is formed with a counter weight stabilizer leg that extends forwardly or rearwardly of the body at an angle with respect to the shaft of the club. The leg acts to stabilize the body of club head during the back stroke and on the return stroke to assist in keeping the face of the club head square with the ball and target.

32 Claims, 2 Drawing Sheets

14
12
2
3
16
18
B
20
6
32a
10
24
28
30
3
6
2
32b
22
26

32a
16
28
32
32b
18
24
26
22
L1

32a
α
12
32
16
28
30
20
32b
L2
18
22

18
16
32
12
28
32
34

COLOR 1
COLOR 1
COLOR 2
COLOR 2
18
16
28
32
36
32a
32b
34
38
12

B
12
16
C
$D_B$
$D_C$
18
32
S 110
132
112
116
B
128
130
118
122
120
S 212
210
232b
232
232a
224
216
218
226

GOLF PUTTER

This invention relates generally to golf putters and more particularly to the construction of the head of such putters.

BACKGROUND OF THE INVENTION

There are numerous golf putter head constructions known to the art. Some, such as those disclosed in U.S. Pat. Nos. 5,458,332 and 5,542,675 have resilient inserts or pads applied to the flat striking face of the head, with the remaining portion being of conventional construction. U.S. Pat. No. 5,597,364 discloses a putting head that is generally cylindrical in construction and has a diameter that closely approximates the diameter of a standard golf ball. With the sizes being the same, it is likely that the head of the club would come into contact with the putting surface prior to or at the time of striking the ball. In order to reduce the drag caused by such contact with the turf, the club head is encapsulated by a layer of friction-reducing material, namely Teflon.

SUMMARY OF THE INVENTION

A golf putter constructed according to the invention comprises a shaft having a grip at one end and a head fixed to the opposite end. The head has a main body section that extends transversely of the shaft. The main body section has a generally cylindrical configuration with a diameter substantially less than that of a standard golf ball. The main body section is encapsulated by a layer of resilient, friction-enhancing material that extends across the striking face of the club head to grip the ball on impact and provide a cushioned, controlled feel when striking the ball.

The relatively small diameter of the body section enables a player to strike the ball at or below its center with the club head without concern of the club head coming into contact with the putting surface. Thus, the smaller diameter obviates the need for a low-friction coating along the lower edge of the club head. Advantageously, the smaller diameter club head makes it possible to encapsulate the head with a friction-enhancing material, as there is little concern for the club head engaging the turf. Such a friction-enhancing material applied to the larger diameter prior art club head would only worsen the condition, as it would increase the frictional resistance to the club head moving forward in the stroke upon striking the turf.

The core of the club head body may be advantageously made of inexpensive materials, such as low carbon steel, that normally would not be considered as a suitable material for a putter head as it is highly susceptible to corrosion. According to a particular embodiment of the invention, the body of the putter head is fabricated of such a corrosion-prone material which is protected against such corrosion by encapsulation by the friction-enhancing layer.

According to another aspect of the invention, the putter head is formed with a counter weight stabilizer leg that extends forwardly or rearwardly of the body at an angle (and preferably about 45°) with respect to the shaft of the club. The leg acts to stabilize the body of the club head during the back stroke and on the return stroke to assist in keeping the face of the club head square with the ball and target. The leg has the further advantage of serving as a visual pointer or guide with which the player may properly orient the head of the club square to the target. The visual guide also encourages the player to focus attention on aligning the leg with the target rather than concentrating on the ball, which helps overcome the nervousness and mistakes that often occur when players concentrate too intensely on the ball.

According to still a further feature of the invention, the body of the leg of the club head is formed with a contrasting color to that of the body of the club to draw the attention of the player to the leg rather than the body of the club head. For example, the body of the club head may be coated with the friction-enhancing material that is black in color, whereas the leg may be coated with the same or similar material that is of a contrasting color, such as red.

The invention also provides methods of manufacturing golf putters having a head of the above type.

THE DRAWINGS

Presently preferred embodiments of the invention are disclosed in the following description and in the accompanying drawings, wherein.

DETAILED DESCRIPTION

Referring now in more detail to the drawings, and initially with particular reference to FIGS. 1–6, a golf putter constructed according to a first embodiment of the invention is generally indicated at 10 and comprises an elongate shaft 12 having a grip 14 mounted on an upper end of the shaft and a club head 16 fixed to the lower end of the shaft 12 in conventional fashion. The shaft 12 may be of the usual type having a generally rigid, elongate cylindrical form or either solid or tubular wall construction and fabricated of steel, aluminum, wood, graphite, composites, or other materials suitable for use as golf club shafts. The grip 14 may likewise be of conventional design and secured to the shaft 12 according to conventional practice for grasping by a player when using the club 10.

Figure 6:
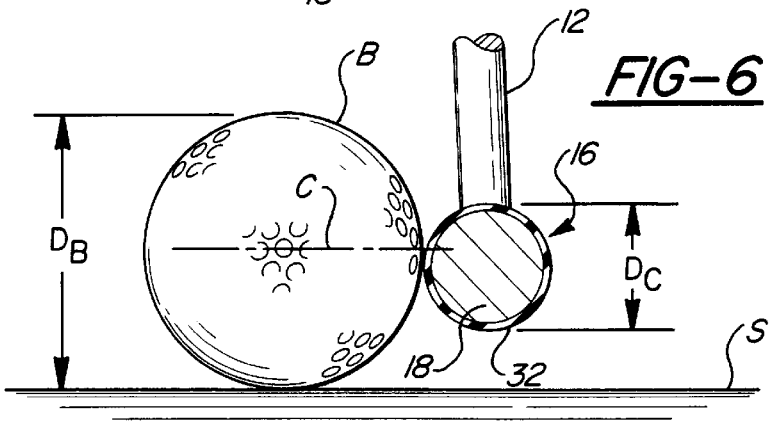
FIG. 6 is a transverse cross-sectional view taken generally along lines 6—6 of FIG. 1 illustrating the size relationship between the club head and a standard golf ball.

According to the invention, the club head 16 has a generally cylindrical main body section 18 that, as best illustrated in FIG. 6, has a diameter $D_c$ which is substantially smaller than the diameter $D_B$ of a standard size golf ball B. The diameter $D_B$ of a standard golf ball B is about 1.68 inches, whereas the diameter $D_C$ of the main body section 18 is preferably about half or less the diameter of the ball B. In the illustrated example, the main body section 18 has a diameter of about 1 inch or less, and preferably in the range of ¾ to ⅞ inches. Such a relatively smaller diameter cylindrical club head 16 is advantageously able to strike the ball B with a face 20 of the club head 16 at a location at or below the central horizontal plane C of the ball B while a lower margin 22 of the club head 16 is spaced above a putting surface S (i.e., a putting green or turf) on which the ball B rests (See FIG. 6). It has been found that striking the ball B with such a small diameter cylindrical club head 16 at a location at or below the center plane C of the ball B has the effect of initiating a forward rolling action on the ball B. The club head 16 is on a slight upswing at the point of impact with the ball B and as such exerts a slight upward and forward rolling force on the ball B upon impact, avoiding the knuckle-ball action usually encountered with flat faces putters or large diameter cylindrical putters.

Figure 1:
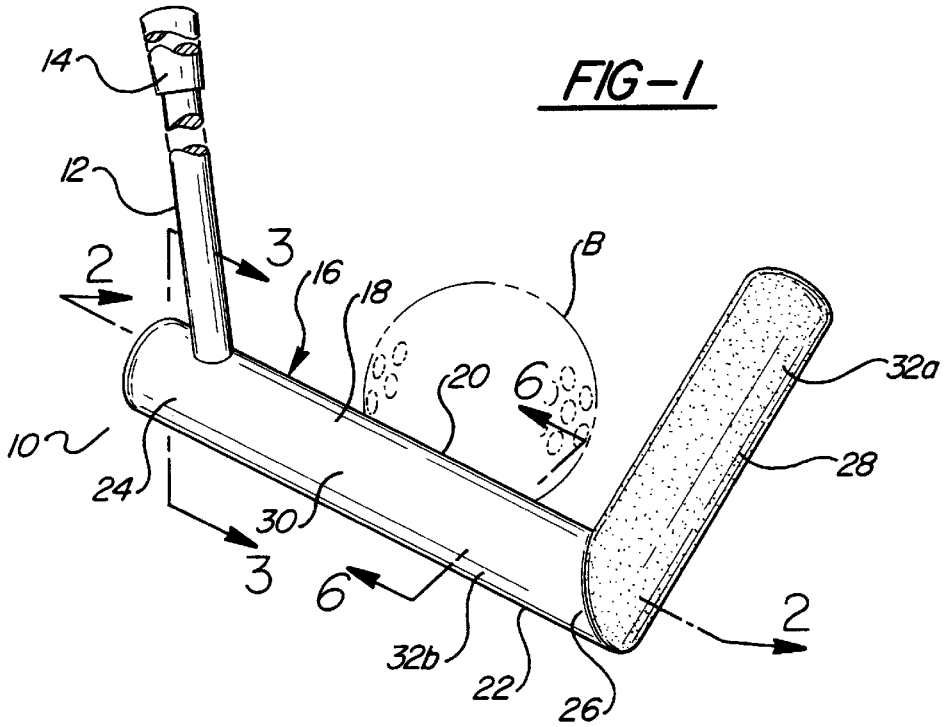
FIG. 1 is a fragmentary perspective view of a golf putter constructed according to one embodiment of the invention.
Figure 2:
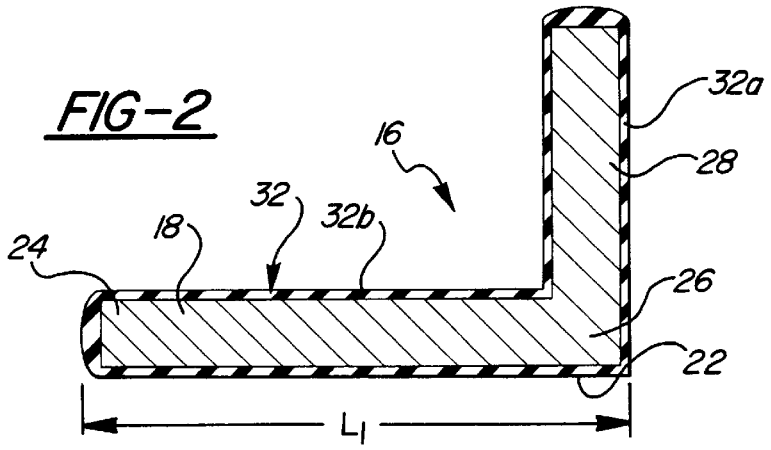
FIG. 2 is a longitudinal cross-sectional view taken generally along lines 2—2 of FIG. 1.
Figure 3:
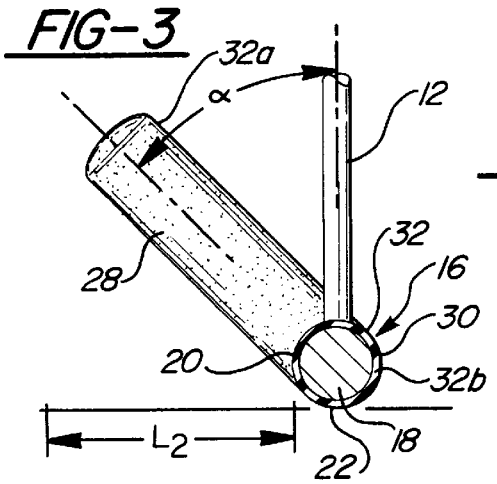
FIG. 3 is a transverse cross-sectional view taken generally along lines 3—3 of FIG. 1.

The main body section 18 extends transversely to the axis of the shaft 12 between a heel 24 at one end of the main body 18 adjacent the shaft 12 and a toe 26 at the opposite end of the main body 18 spaced outwardly from the shaft 12 on the side opposite the player. The main body section 18 has a predetermined length $L_1$ between its ends preferably in the range of about 4 to 6 inches and more preferably about 5 inches. The club head 16 may also include a weighted stabilizer leg 28 that extends from the toe 26 wither forwardly or rearwardly of the club face 20 at a right angle to the body 18 and at a predetermined angle a laterally forwardly or rearwardly with respect to the shaft 12, (preferably at a 45° angle). The leg 28 may likewise be cylindrical and of the same diameter as the body 18. FIGS. 1–6 illustrate a putter 10 whose leg 28 projects forwardly of the club face 20. It will be appreciated, however, that the side 30 of the main body 18 opposite the club face surface 20 could serve equally as a club face for an oppositely handed player. FIG. 1 depicts usage of the club 10 by a right-handed player, and in such case the leg 28 projects forwardly of the club face 20. However, the side 30 could just as well be used as the striking face of the club head 16 by a left-handed player, in which case the leg 28 would project rearwardly of the club face 30.

Figure 7:
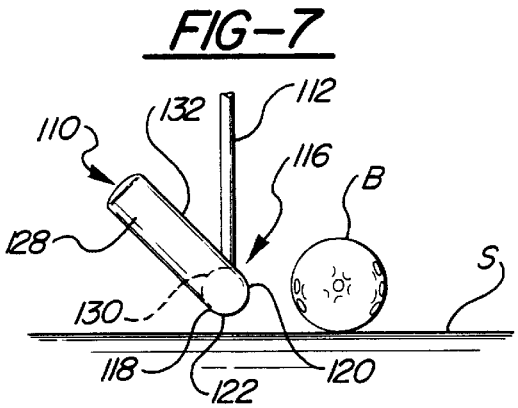
FIG. 7 is an end elevation view of a golf putter constructed according to an alternative embodiment of the invention.

Alternatively, FIG. 7 illustrates a golf putter 110 constructed according to another embodiment of the invention, in which the same reference numerals are used to designate like features with the putter 10 of the first embodiment but are offset by 100, wherein the leg 128 is positioned in the reverse orientation, such that for right-handed usage the leg 128 extends rearwardly of the putting face 120, and for a left handed player the leg 128 extends forwardly. The putter 110 is otherwise identically constructed.

Referring again to the first embodiment for the sake of clarity, the angled stabilizer leg 28 has the effect of exerting a torque force on the shaft 12 in the direction of its inclination, which is felt by the player when grasping the club 10. The torque gives a sense of stability to the club 10 as it provides a directional force that the player must counteract when supporting the club 10. Advantageously, the force is exerted at a right angle to the club face 20, 30 which assists the player in maintaining the club face 20, 30 in desirable square relation to the line of a put through the back swing and forward swing. In other words, the leg 28 has the effect of requiring the player to counteract the torque force with an applied resistance force at a right angle to the club face 20, 30, thereby stabilizing the club head 16 for movement in correct line with a desired target.

The upward angle of the stabilizer leg 28 has the further advantage of minimizing any possibility of the leg 28 striking the putting surface S on the back or forward swing. The small diameter body 18 and upward angled leg 28 further make the club 10 ideal for putting the ball 10 out of deep fringe that often surrounds many putting greens. The small diameter body 18 glides smoothly through the grass and the upward leg, particularly if rearwardly directed, does not add to any appreciable degree to the resistance of the club head 16 moving through the grass, and in fact helps somewhat by adding weight and thus momentum to the club head 16 on the forward stroke.

The stabilizer leg 28 may be fabricated of the same material as that used for the body 18 and may be fabricated as either a separate piece which is subsequently secured, such as by welding, to the body 18, or as formed such as by casting or machining as one unitary piece. For example, the entire head 16, including the body 18 and leg 28 may be fabricated from two sections of cylindrical rod stock which are mitered and then welded together in the described angular orientation. The head 16 may alternately be cast as one piece.

Figure 4:
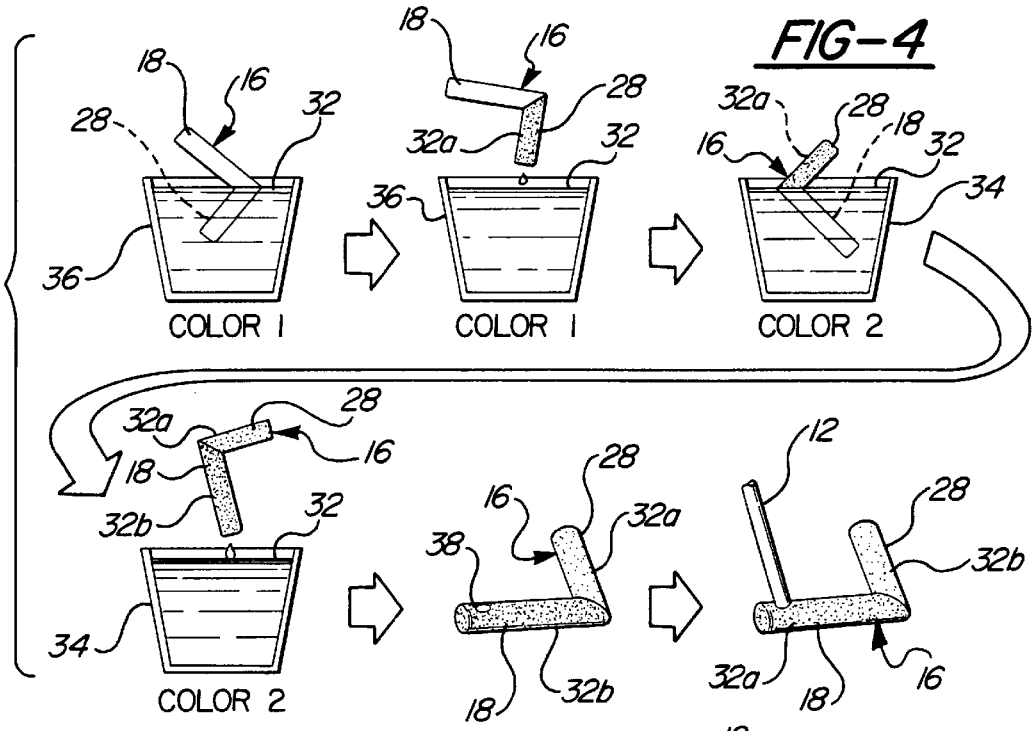
FIG. 4 is a schematic diagrammatic view illustrating a method of constructing a golf putter having a multi-color coated head according to the invention.

Referring to FIG. 4, it will be seen that the stabilizer leg 28 extends a predetermined distance $L_2$ from the club face 20 when measured at a right angle to the shaft 12, which is relatively less than the length $L_1$ of the body 18 of the club head 16. The leg 28 has an extension distance $L_2$ in the range of about 2 to 4 inches, and preferably 3 inches, with the distance $L_2$ always being less than the length $L_1$.

The main body section 18 may be fabricated of any of a number of materials, including aluminum, magnesium, stainless steel, titanium, brass, bronze, copper, and alloys thereof along with other materials conventionally employed to construct golf putter heads. The leg 28 may be fabricated from the same or different materials as that used for the main body 18. Included among the candidate materials for either or both of the body 18 and leg 28 are inexpensive materials such as corrosion-proof grades of steel, and for example plain carbon steel which, by their nature, are prone to corrosion (i.e., rusting) when exposed to the elements. It will be appreciated by those familiar with the game of golf that the clubs, including the putter, are exposed to water, mud, humidity, salt, lawn care chemicals, etc., that would act to accelerate the corrosion of a club head 16 made of plain steel if exposed to such an environment for a length of time.

According to the invention, at least the main body section 18, and preferably the leg 28 as well, is encapsulated by an outer applied layer or skin 32 of resiliently compressible friction-enhancing plastics material. As illustrated best in FIGS. 2 and 3, the layer 32 comprises a generally uniform thickness coating of a friction-enhancing material that completely envelops at least the main body section 18 and preferably the entire club head 16. In this way, at least the main section 18 and preferably the leg 28 as well are encased by the skin 32 and protected thereby from exposure to the elements that might otherwise subject the club head 16 to corrosion. Thus, the skin 32 advantageously enables an inexpensive corrosion-prone material such as plain carbon steel to be used for the club head 16 without concern for it corroding during normal use.

The material for the outer layer or skin 32 preferably comprises a rubbery plastics material that is resiliently compressible, tough, abrasion resistant, and form-fitting to the club head 16. A suitable material for the outer skin 32 comprises a solvent-based polymeric rubberized shrinkable dip coating manufactured by PDI, Inc., and available commercially as PLASTIDIP. The product material is identified as being manufactured under U.S. Pat. No. 4,536,454, the disclosure of which is incorporated herein by reference. The coating is applied in such manner as to control the thickness of the skin 32 to preferably within the range of about 0.01 to 0.125 inches. The desired coating thickness provides sufficient material to cushion the initial impact force of the ball B, while transmitting the remaining force to the body or core 18 of the club head 16 to give the club 10 a solid, but soft-touch controlled feel. The object is not to have the ball B bounce off the skin 32, but rather to provide a certain amount of grip-enhancing resiliency so that as the club face 20 strikes that ball B, the skin 32 responds by compressing to conform momentarily to the shape of the ball B, as illustrated in FIG. 6, to provide a soft touch gripping action on the ball B, and then returning to shape as the ball B leaves the face 20, aiding further in the smooth, controlled action of the putter 10 on the ball B.

FIG. 6 also shows how the relatively small diameter of the body 18 with the skin 32 applied is permitted to strike the ball B at or below its center plane C while the lower margin 22 of the body 18 is well above the putting surface S. In this way, the friction-enhancing skin 32 is able to be applied to the entire surface of the club head 16, including the lower margin 22, without concern for the lower margin 22 striking the turf S during the swing.

Figure 5:
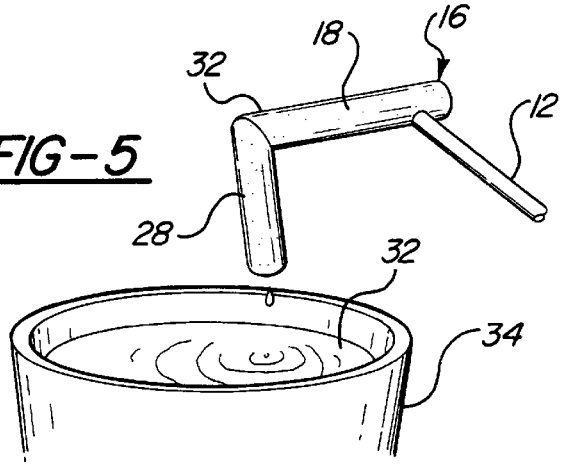
FIG. 5 is a schematic diagrammatic view illustrating an alternative method of constructing a golf putter according to the invention.

FIGS. 4 and 5 illustrate methods of manufacturing the putter 10, and particularly the club head 16, according to the invention. FIG. 5 illustrates a single color dip process, wherein a vat 34 of the layer material 32 of predetermined color (e.g., black) is provided which, in its initial state in the vat 34 is in the form of a viscous liquid. The head 16 of the putter 10 is dipped into the vat 34 to coat the head 16 with the material 32, and is then withdrawn and the excess allowed to drip off the toe 26 of the club head 16 back into the vat 34. In a relatively short time (i.e., within about 24 hours), the solvent of the material is driven off and the material is caused to shrink form about the shaft 16 to provide the relatively thin, uniform skin of the material that exhibits the desirable friction-enhancing characteristics. If desired, the club head 16 may be dipped several times to achieve the desired thickness.

FIG. 4 illustrates a two color process wherein an additional vat 36 is provided having the coating material of a second contrasting color (e.g., color 1-red) to that of the color (e.g., color 2-black) in the first vat 34. According to this alternative process, the leg 28 of the club head 16 is dipped in the vat 36 to develop the skin 32*a* thereon of one color (e.g., red) and allowed to at least partially set or dry, and then the body 18 is dipped in the other vat 34 to provide the skin $\mathbf{32}_b$ thereon of the second color (e.g., black). In the process, the two partial skins are chemically united to provide a continuous impermeable skin 32. Following the formation of the skin 32, a hole 38 may be machined into the body 18 of the club head 16 to receive the shaft 12.

Figure 8:
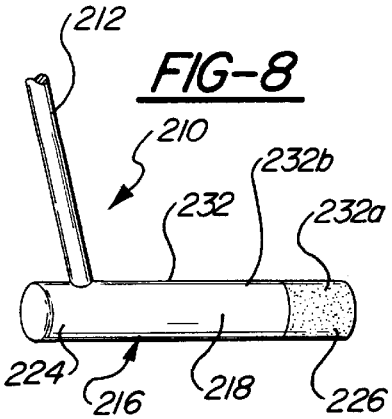
FIG. 8 is a rear elevation view of a golf putter constructed according to a further embodiment of the invention.

FIG. 8 illustrates an alternative embodiment of a putter 210 constructed according to another embodiment of the invention, wherein like reference numerals have been used to reference like features to the first embodiment, but are offset by 200. The putter 210 is the same as the putter 10 of the first embodiment, except that the club head 216 lacks the stabilizer leg 28, and the skin 232 applied to the body 218 is preferably of a multiple contrasting color prepared according to the general process previously described with reference to FIG. 4. A partial skin coating $\mathbf{232}_a$ is applied to the majority of the body 218 of a first color (e.g., black). A partial skin coating $\mathbf{232}_b$ is applied to the toe end 226 of the body 218 of a contrasting color (e.g., red). The contrasting color has the effect of focusing the attention of the player on the toe end 226 rather than on the ball B while putting, in order to assist in properly aligning the path of the ball B with the desired target.

The disclosed embodiments are representative of presently preferred forms of the invention, but are intended to be illustrative rather than definitive thereof. The invention is defined in the claims.

I claim:

1. A golf putter construction comprising:

an elongate shaft having an upper end and a lower end;

a grip secured to said upper end of said shaft;

a club head secured to said lower end of said shaft, said club head having a generally cylindrical body section extending transversely of the shaft between an inward heel end of said body and an outward toe end of said body and including a striking face and a lower margin and having a diameter less than the diameter of a golf ball; and a skin layer of elastically compressible plastics material having substantially uniform friction-enhancing properties enveloping said body section including about said striking face and said lower margin.

2. The construction of claim 1 wherein said body section is fabricated of metal.

3. The construction of claim 2 wherein said metal comprises a corrosion prone metal and wherein said skin layer protects said body section against exposure to corrosive environments.

4. The construction of claim 3 wherein said corrosion prone metal comprises plain carbon steel.

5. The construction of claim 1 wherein said plastics material comprises a plastics dip coating.

6. The construction of claim 1 wherein said body section is less than about 1 inch in diameter.

7. The construction of claim 1 wherein said club head includes a stabilizer leg extending from said toe end of said body section at a right angle to said body section.

8. The construction of claim 7 wherein said stabilized leg extends upwardly and transversely of said body section at a predetermined angle laterally with respect to said shaft.

9. The construction of claim 8 wherein said predetermined angle comprises about 45°.

10. The construction of claim 7 wherein said skin layer envelops said stabilizer leg.

11. The construction of claim 10 wherein the portion of said skin layer applied to said body section is of a first color and the portion of said skin layer applied to said stabilizer leg is of a second contrasting color.

12. The construction of claim 11 wherein said skin layer portion of said body section is black in color and said skin layer portion of said stabilizer leg is red in color.

13. The construction of claim 8 wherein said body section includes a cylindrical first club face and said stabilizer leg projects forwardly of said club face.

14. The construction of claim 13 wherein said body section includes a cylindrical second club face opposed to said first club face.

15. The construction of claim 8 wherein said body section includes a first club face and said leg section project rearwardly of said club face.

16. The construction of claim 7 wherein said leg section has a cylindrical shape and is of the same diameter as that of said body section.

17. The construction of claim 7 wherein said body section has a predetermined length between ends thereof and said leg section extends laterally beyond said shaft by a distance relatively less than that of said length of said body section.

18. The construction of claim 1 wherein said skin layer is multi-colored.

19. The construction of claim 18 wherein a portion of said skin layer covering a majority of said body section is of a first color and a portion of said skin layer covering said toe end region of said body section is of a second contrasting color.

20. A method of constructing a golf putter comprising:

preparing an elongate shaft having opposite upper and lower ends;

mounting a grip to the upper end of the shaft;

preparing a putter head having a generally cylindrical body section with a striking face and a lower margin and a diameter less than the diameter of a golf ball;

applying an elastically compressible plastics material with generally uniform friction-enhancing properties to the club head to envelop the body section including the striking face and the lower margin; and mounting the head to the lower end of the shaft.

21. The method of claim 20 including forming a stabilizer leg extending at a substantially right angle to the body section from a toe end of the body section and mounting the club head to the shaft such that the stabilizer leg projects upwardly at an angle from the body section laterally of the shaft.

22. The method of claim 21 including applying the plastics layer material to the stabilizer leg.

23. The method of claim 22 including applying such plastics material of a first color to the body section and applying such plastics material of a second contrasting color to said stabilizer leg.

24. The method of claim 20 wherein the plastic material is applied as a dip coating.

25. The method of claim 20 wherein a majority of the body section is coated with such plastics material of a first color and a toe end of the body section is coated with such plastics material of a second contrasting color.

26. The method of claim 20 wherein the cylindrical body section is prepared having a diameter of less than about 1 inch.

27. The method of claim 21 wherein the club head is mounted on the shaft to position the stabilizer leg at about a 45° angle with respect to the shaft.

28. A method of constructing a golf putter comprising:

preparing an elongate shaft having an upper end and a lower end;

mounting a grip to the upper end of the shaft;

mounting a putter head to the lower end of the shaft having a striking face and a lower margin; and dip-coating the putter head with an elastically compressible plastics material having generally uniform friction-enhancing properties to provide an enveloping layer of such material about the putter head including the striking face and the lower margin.

29. The method of claim 28 including applying multiple dip coat layers to the putter head.

30. The method of claim 28 including applying at least two different colored dip coat regions to the putter head.

31. A golf putter construction comprising:

an elongate shaft having an upper end and a lower end;

a grip secured to said upper end of said shaft;

a club head secured to said lower end of said shaft, said club head having a generally cylindrical body extending transversely of the shaft between an inward heel end of said body and an outward toe of said body and having a diameter substantially less than the diameter of a golf ball, and said club head including a stabilizer leg extending from said toe end of said body section at a right angle to said body section.

32. A method of constructing a golf putter comprising:

preparing an elongate shaft having opposite upper and lower ends;

mounting a grip to the upper end of the shaft;

preparing a putter head having a cylindrical body section with a diameter substantially less than the diameter of a golf ball;

forming a stabilizer leg extending at a substantially right angle to the body section from a toe end of the body section and mounting the club head to the shaft such that the stabilizer leg projects upwardly at an angle from the body section laterally of the shaft;

applying a friction-enhancing, elastically compressible plastics material to the club head to provide an enveloping layer encapsulating the body section; and mounting the head to the lower end of the shaft.

* * * * *

UNITED STATES PATENT AND TRADEMARK OFFICE

CERTIFICATE OF CORRECTION

PATENT NO. : 6,017,281
DATED : January 25, 2000
INVENTOR(S) : Gary A. Behling

It is certified that error appears in the above-identified patent and that said Letters Patent is hereby corrected as shown below:

Column 3, line 22, "a" should be --α--.

Signed and Sealed this

Third Day of April, 2001

Nicholas P. Godici

*Attest:*

NICHOLAS P. GODICI

*Attesting Officer*

*Acting Director of the United States Patent and Trademark Office*